US010008800B2

(12) United States Patent
Inoue

(10) Patent No.: US 10,008,800 B2
(45) Date of Patent: Jun. 26, 2018

(54) TERMINAL AND METHOD FOR PRODUCING THE SAME

(71) Applicant: FUJIKURA LTD., Tokyo (JP)

(72) Inventor: Nobuaki Inoue, Sakura (JP)

(73) Assignee: FUJIKURA LTD., Tokyo (JP)

( * ) Notice: Subject to any disclaimer, the term of this patent is extended or adjusted under 35 U.S.C. 154(b) by 0 days. days.

(21) Appl. No.: 15/507,482

(22) PCT Filed: Oct. 9, 2015

(86) PCT No.: PCT/JP2015/078834
§ 371 (c)(1),
(2) Date: Feb. 28, 2017

(87) PCT Pub. No.: WO2016/056660
PCT Pub. Date: Apr. 14, 2016

(65) Prior Publication Data

US 2017/0302017 A1 Oct. 19, 2017

(30) Foreign Application Priority Data

Oct. 10, 2014 (JP) ..... 2014-208602
Oct. 10, 2014 (JP) ..... 2014-208603
Nov. 19, 2014 (JP) ..... 2014-234225

(51) Int. Cl.
*H01R 13/187* (2006.01)
*H01R 13/11* (2006.01)
*H01R 43/16* (2006.01)

(52) U.S. Cl.
CPC ..... *H01R 13/111* (2013.01); *H01R 43/16* (2013.01)

(58) Field of Classification Search
CPC ... H01R 13/187; H01R 13/111; H01R 13/113; H01R 9/091
(Continued)

(56) References Cited

U.S. PATENT DOCUMENTS 4,002,400 A * 1/1977 Evans ..... H01R 13/111 439/748
4,784,622 A * 11/1988 Senor ..... H01R 12/58 439/853
(Continued)

FOREIGN PATENT DOCUMENTS

JP 4-102167 U1 9/1992
JP 10-116644 A 5/1998
(Continued)

OTHER PUBLICATIONS

International Search Report dated Dec. 1, 2015, issued in counterpart International Application No. PCT/JP2015/078834 (2 pages).
(Continued)

*Primary Examiner* — Thanh Tam Le
(74) *Attorney, Agent, or Firm* — Westerman, Hattori, Daniels & Adrian, LLP

(57) ABSTRACT

A terminal (1) includes a wire connecting portion (11) to be connected to a wire (4), and a terminal connecting portion (12) to be connected to a counterpart terminal (5). The terminal connecting portion (12) includes first contact portions (321) to be connected to the counterpart terminal (5), and second contact portions (331) to be connected to the counterpart terminal (5). The first contact portions (321) and the second contact portions (331) are disposed to be shifted from each other along an axial direction of the terminal connecting portion (12).

8 Claims, 9 Drawing Sheets

(58) Field of Classification Search
USPC ..... 439/843, 851–854
See application file for complete search history.

(56) References Cited

U.S. PATENT DOCUMENTS

| | | | | |
|---|---|---|---|---|
| 4,906,212 | A * | 3/1990 | Mixon, Jr. | H01R 13/111 439/857 |
| 5,135,403 | A * | 8/1992 | Rinaldi | H01R 12/585 439/82 |
| 5,667,413 | A * | 9/1997 | Trafton | H01R 13/187 439/271 |
| 5,857,879 | A | 1/1999 | Endo et al. | |
| 6,186,841 | B1 * | 2/2001 | Jacobsson | H01R 13/111 439/851 |
| 6,250,974 | B1 * | 6/2001 | Kerek | H01R 13/187 439/843 |
| 6,899,572 | B1 * | 5/2005 | Baker | H01R 13/111 439/181 |
| 6,955,569 | B2 * | 10/2005 | Baker | H01R 13/18 439/839 |
| 7,942,682 | B2 * | 5/2011 | Copper | H01R 13/187 439/185 |
| 9,325,095 | B2 * | 4/2016 | Glick | H01R 13/187 |
| 9,444,168 | B2 * | 9/2016 | Horiuchi | H01R 13/111 |
| 9,601,856 | B2 * | 3/2017 | Regantini | H02B 11/04 |
| 2013/0017739 | A1 | 1/2013 | Glick et al. | |
| 2013/0109250 | A1 | 5/2013 | Haga | |

FOREIGN PATENT DOCUMENTS

| | | | |
|---|---|---|---|
| JP | 10-125378 | A | 5/1998 |
| JP | 2010-211988 | A | 9/2010 |
| JP | 2013-98088 | A | 5/2013 |
| JP | 2013-161640 | A | 8/2013 |
| WO | 1998/018182 | A1 | 4/1998 |

OTHER PUBLICATIONS

Office Action dated Mar. 27, 2018, issued in counterpart Japanese application No. 2014-208603, with English translation. (7 pages).
Office Action dated Mar. 27, 2018, issued in counterpart Japanese application No. 2014-234225 with English translation. (6 pages).
European Search Report dated Apr. 18, 2018, issued in counterpart Application No. 15849147.2 (11 pages).

* cited by examiner

TERMINAL AND METHOD FOR PRODUCING THE SAME

TECHNICAL FIELD

The present invention relates to a terminal and a method for producing the same.

The disclosure is based upon and claims the benefit of priority from Japanese Patent Application No. 2014-208602, filed on Oct. 10, 2014, Japanese Patent Application No. 2014-208603, filed on Oct. 10, 2014, and Japanese Patent Application No. 2014-234225, filed on Nov. 19, 2014, the entire contents of which are incorporated herein by reference.

BACKGROUND ART

There is a known female terminal which includes a cylindrical contact portion for inserting a terminal pin of a male terminal and ensures a connection with the male terminal using a protrusion provided in a thin wall portion of the cylindrical contact portion on a terminal pin insertion end side (see Patent Document 1).

CITATION LIST

Patent Document

Patent Document 1: JP 10-116644 A

SUMMARY OF THE INVENTION

Problem to be Solved by the Invention

In the above-described female terminal, a plurality of protrusions provided in the cylindrical contact portion is disposed at substantially the same distance in a direction of the connection with the male terminal. Accordingly, dirt, dust, etc. attached to a surface of the male terminal are collected in a certain place on the surface of the male terminal by the protrusions of the female terminal when the male terminal is inserted into the female terminal. For this reason, there is a problem that dirt, dust, etc. are accumulated on the surface of the male terminal when the terminals are repeatedly attached and detached to and from each other, and a poor connection may occur between the terminals.

An object of the present invention is to provide a terminal capable of ensuring an excellent connection and a method for producing the same.

Means for Solving Problem

[1] A terminal according to the invention is a terminal including a wire connecting portion to be connected to a wire, and a terminal connecting portion to be connected to a counterpart terminal, wherein the terminal connecting portion includes first contact portions to be connected to the counterpart terminal, and second contact portions to be connected to the counterpart terminal, and the first contact portions and the second contact portions are disposed to be shifted from each other along an axial direction of the terminal connecting portion.

[2] In the above invention, the first contact portions may be relatively positioned on a side of a distal end of the terminal connecting portion with respect to the second contact portions in the axial direction of the terminal connecting portion, and the first contact portions may be relatively positioned on a side of a central axis of the terminal connecting portion with respect to the second contact portions in a radial direction of the terminal connecting portion.

[3] In the above invention, the terminal connecting portion may include a connecting piece forming an insertion space for inserting the counterpart terminal, the connecting piece may include first connecting pieces which have the first contact portions at distal ends of the first connecting pieces for elastically pinching the counterpart terminal, and second connecting pieces which have the second contact portions at distal ends of the second connecting pieces for elastically pinching the counterpart terminal, and a length of the first connecting piece along the axial direction in the terminal connecting portion may be relatively longer than a length of the second connecting piece along the axial direction in the terminal connecting portion.

[4] In the above invention, the second connecting pieces may have wide-width portions in which the second contact portions are provided, and a total area of the second contact portions may be relatively larger than a total area of the first contact portions.

[5] In the above invention, each of the wide-width portions may have the second contact portions.

[6] In the above invention, the first connecting pieces and the second connecting pieces may be alternately disposed at substantially equal intervals along a circumferential direction of the insertion space.

[7] In the above invention, the first connecting pieces may be disposed to face each other through the insertion space, and the second connecting pieces may be disposed to face each other through the insertion space.

[8] In the above invention, the terminal connecting portion may have a first plated layer which covers a surface of the connecting piece, and the wire connecting portion may have a second plated layer relatively harder than the first plated layer.

[9] A method for producing a terminal according to the invention is a method for producing a terminal including connecting pieces arranged along a circumferential direction with intervals, the connecting pieces having contact portions to contact with a counterpart terminal, the method including a first process of forming a processed body by performing a cutting process on a plate-shaped member, the processed body including a base portion and the connecting pieces extending from one end of the base portion, a second process of processing the processed body in a cylindrical shape, a third process of forming a main body member having a hole portion, and a fourth process of inserting the base portion into the hole portion, wherein the contact portions include first contact portions to be connected to the counterpart terminal, and second contact portions to be connected to the counterpart terminal, and the first contact portions and the second contact portions are disposed to be shifted from each other along an axial direction of the terminal connecting portion.

[10] In the above invention, the base portion may include a connection portion through which the connecting pieces connect to each other, a first insertion piece which has a protrusion and extends from the other end of the base portion, and a second insertion piece which has a locking protrusion and extends from the other end, the first process may include forming the protrusion in the first insertion piece and forming the locking protrusion in the second insertion piece, the third process may include forming a step in an inner wall of the hole portion, and the fourth process may include locking the locking protrusion to the step and contacting the protrusion with the inner wall.

[11] In the above invention, Young's modulus of a material contained in the plate-shaped member may be relatively larger than Young's modulus of a material contained in the rod-shaped member.

[12] In the above invention, the second process may include forming a first plated layer on a surface of the processed body processed in the cylindrical shape, the third process may include forming a second plated layer on a surface of the main body member, and the first plated layer may be relatively harder than the second plated layer.

Effect of the Invention

According to the invention, a first contact portion and a second contact portion included in a terminal connecting portion are disposed to be shifted from each other along an axial direction of the terminal connecting portion. Therefore, it is possible to reduce dirt or dust accumulated in a certain place of a counterpart terminal connected to the terminal and to attempt an excellent connection.

BRIEF DESCRIPTION OF DRAWINGS

FIGS. 3(A) and 3(B) are diagrams illustrating a connecting member of the terminal in the embodiment of the invention, wherein FIG. 3(A) is a perspective view, and FIG. 3(B) is a cross-sectional view taken along IIIB-IIIB line of FIG. 3(A);

FIGS. 6(A) and 6(B) are diagrams illustrating a modified example of the connecting member of the terminal in the embodiment of the invention, wherein FIG. 6(A) is a perspective view, and FIG. 6(B) is a cross-sectional view taken along VIB-VIB line of FIG. 6(A);

MODE(S) FOR CARRYING OUT THE INVENTION

Hereinafter, an embodiment of the invention will be described with reference to drawings.

Figure 1:
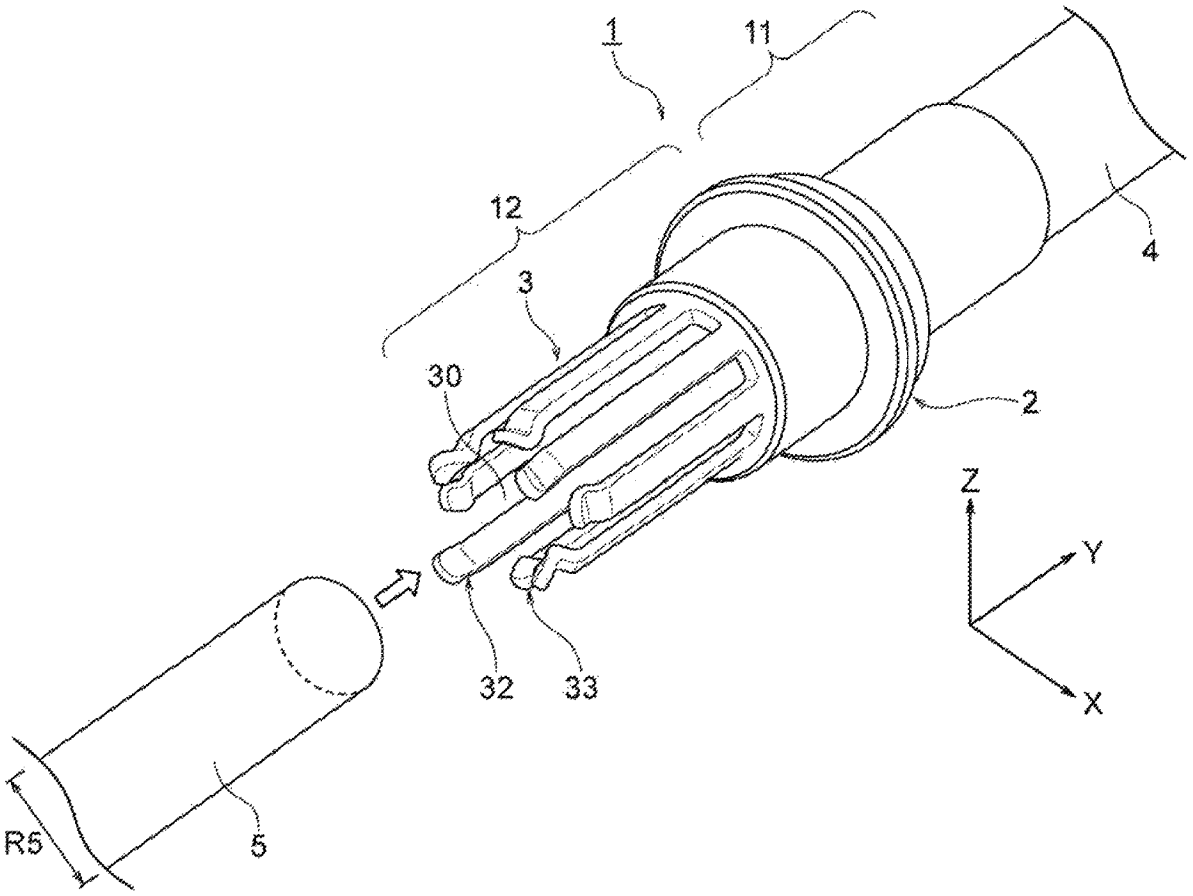
FIG. 1 is a perspective view illustrating a terminal in an embodiment of the invention.
Figure 2:
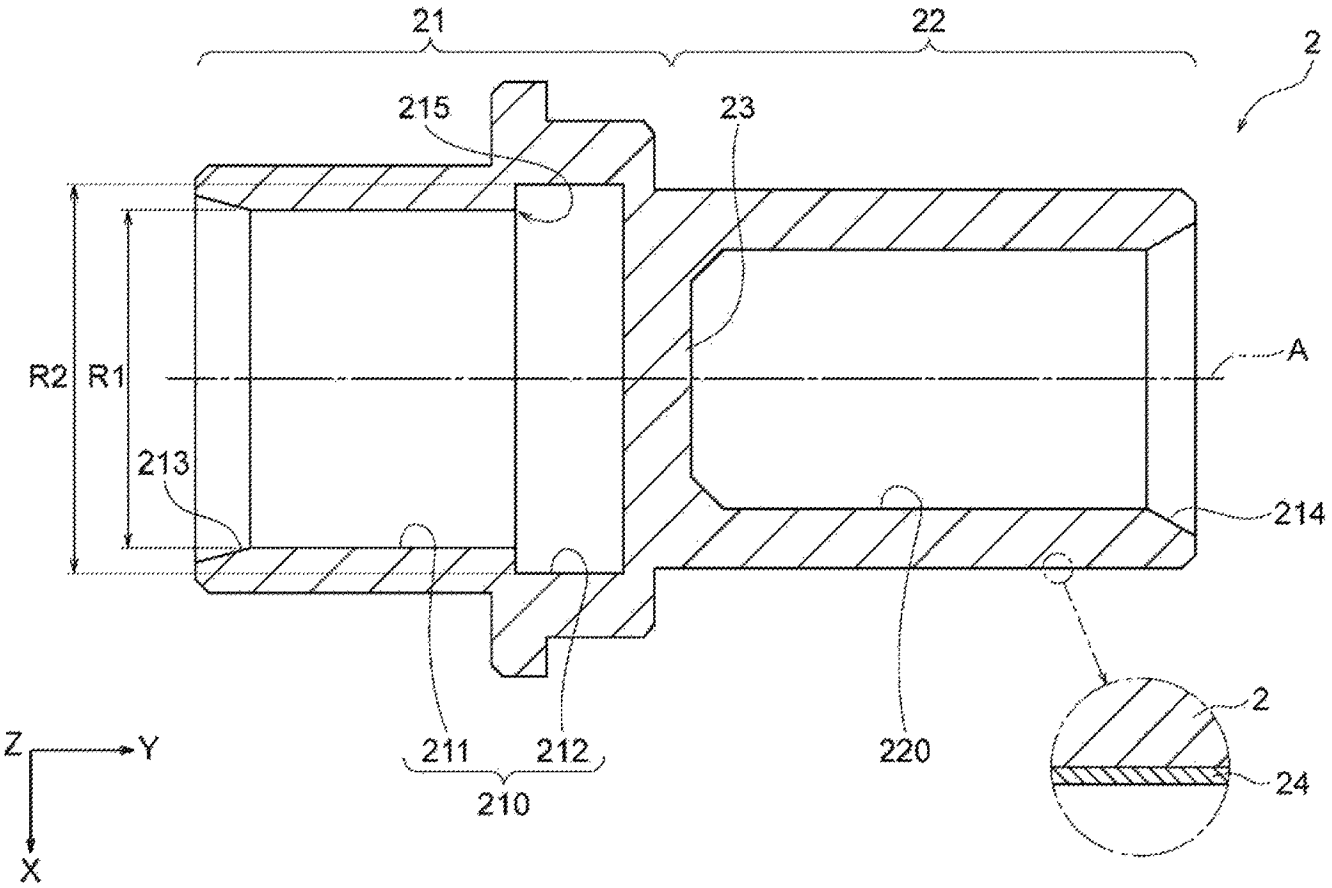
FIG. 2 is a cross-sectional view illustrating a main body member of the terminal in the embodiment of the invention.
Figure 3:
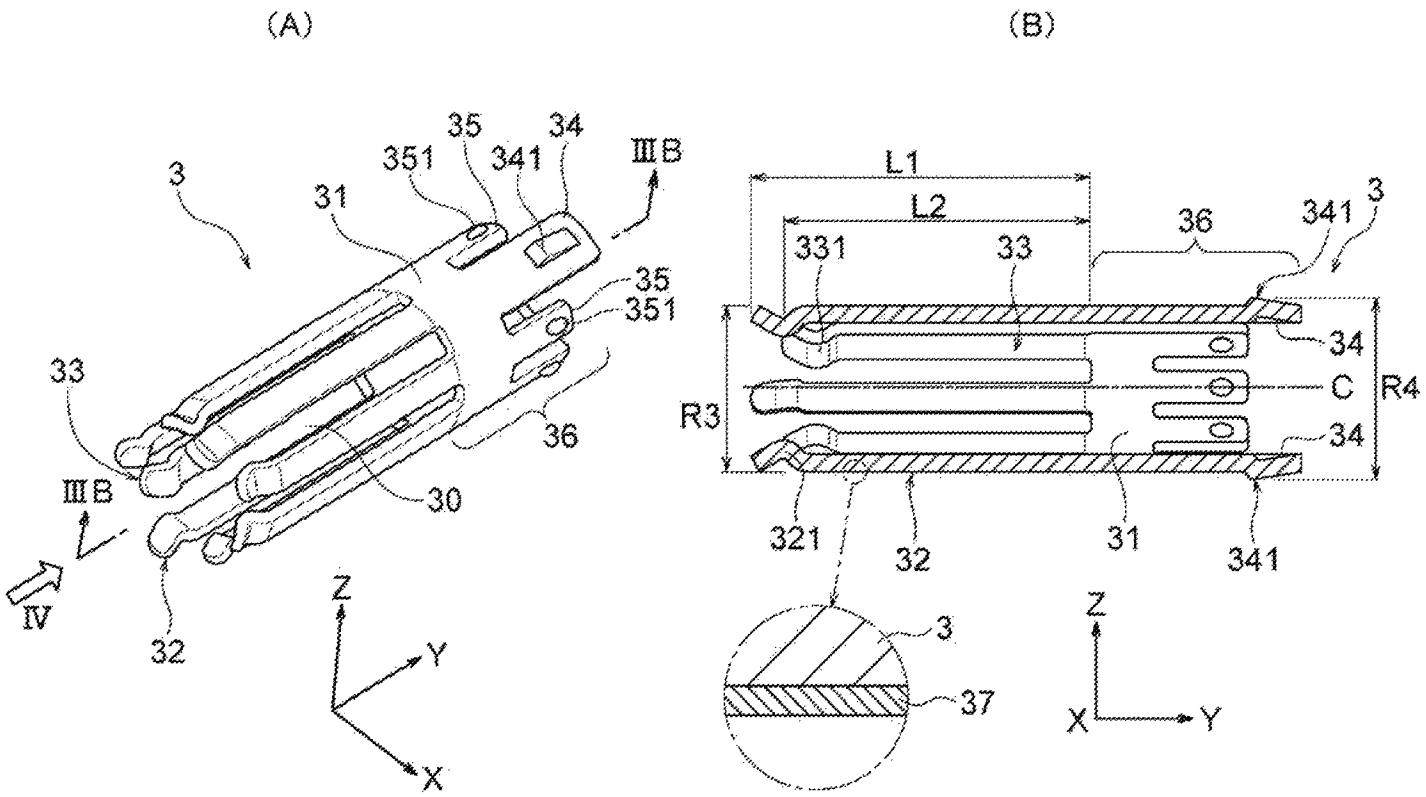
Figure 4:
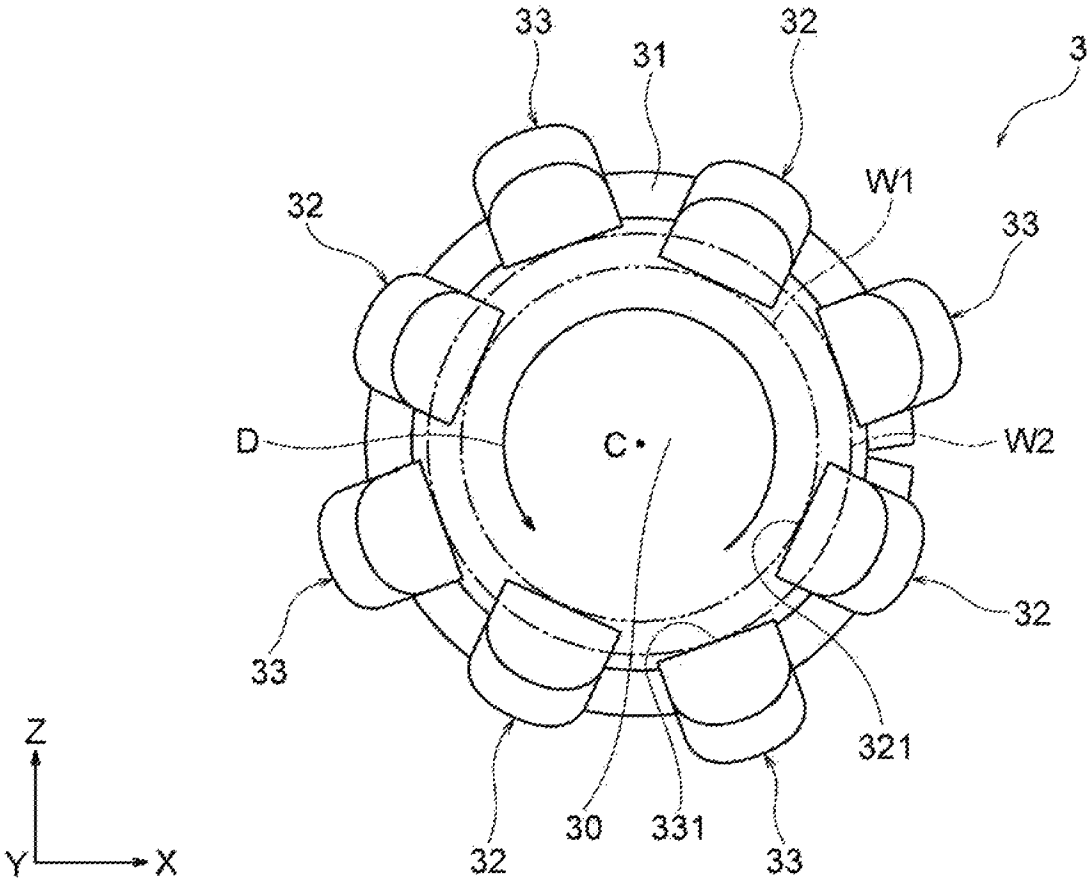
FIG. 4 is an arrow view in a direction IV of FIG. 3(A)

FIG. 1 is a perspective view illustrating a terminal in the present embodiment, FIG. 2 is a cross-sectional view illustrating a main body member of the terminal in the present embodiment, FIGS. 3(A) and 3(B) are a perspective view and a cross-sectional view illustrating a connecting member of the terminal in the embodiment of the invention, and FIG. 4 is an arrow view in a direction IV of FIG. 3(A).

A terminal 1 in the present embodiment is, for example, a terminal (female terminal) used for a charging connector mounted at a vehicle side of an electric vehicle, and includes a wire connecting portion 11 connected to a wire 4 at the time of mounting and a terminal connecting portion 12 connected to a counterpart terminal 5 as illustrated in FIG. 1. As a specific configuration, the terminal 1 includes two members (a main body member 2 and a connecting member 3 attached to the main body member 2). As illustrated in FIG. 1, the counterpart terminal 5 in the present embodiment has a cylindrical shape which can be inserted into the terminal connecting portion 12 of the terminal 1.

As illustrated in FIG. 2, the main body member 2 has a cross-sectional shape which is rotationally symmetric about a central axis A, and includes a connecting piece attaching portion 21 to which the connecting member 3 is attached and a wire attaching portion 22 to which the wire 4 (see FIG. 1) is attached at the time of mounting. The main body member 2 is integrally formed as a whole, and examples of a material contained in the main body member 2 may include a metal material such as pure copper, a copper alloy such as brass, aluminum, and stainless steel, etc. A direction along the central axis A of the main body member 2 and a central axis C of the connecting member 3 described below in the present embodiment corresponds to an example of "an axial direction of the terminal connecting portion" of the invention.

Various plating processes may be performed on a surface of the main body member 2 to form a plated layer 24 on the surface of the main body member 2. The plated layer 24 is preferably softer than a plated layer 37 of the connecting member 3 described below, and has hardness in a range of about 80 to 110 Hv. For example, specific examples of the plated layer 24 may include a soft silver (Ag) plated layer having a thickness in a range of about 5 to 10 μm. In this way, when the plated layer 24 of the main body member 2 is softer than the plated layer 37 of the connecting member 3, excellent conductivity may be ensured when the wire 4 and the main body member 2 are crimped to each other. The plated layer 24 in the present embodiment corresponds to an example of a second plated layer in the invention.

A hole portion 210 is formed in the connecting piece attaching portion 21, and the hole portion 210 includes a small diameter portion 211 having an inner diameter R1 and a large diameter portion 212 having an inner diameter R2 larger than the inner diameter R1 (R2>R1). The small diameter portion 211 is provided on a −Y direction side of the large diameter portion 212 in FIG. 2, and a step 215 is formed across a whole circumference on an inner wall at a boundary between the small diameter portion 211 and the large diameter portion 212 due to a difference in inner diameter therebetween. The connecting member 3 described below is inserted into and fixed to the hole portion 210. A tapered shape 213 is formed across a whole circumference at an end portion of the small diameter portion 211, and an insertion operation is facilitated due to the presence of the tapered shape 213 when the connecting member 3 is attached to the connecting piece attaching portion 21. The hole portion 210 in the present embodiment corresponds to an example of a hole portion of the invention.

A hole portion 220 having a predetermined inner diameter depending on a diameter of a conductor portion of the wire 4 is formed in the wire attaching portion 22, and a tapered shape 214 is formed across a whole circumference on an end portion of the hole portion 220. At the time of mounting the terminal 1, the conductor portion of the wire 4 is inserted into the hole portion 220, and the wire attaching portion 22 is caulked from an outer circumference to press the wire attaching portion 22 against the conductor portion, thereby the conductor portion and the wire attaching portion 22 are electrically connected to each other. An insertion operation is facilitated due to the presence of the tapered shape 214 when the wire 4 is attached to the wire attaching portion 22.

Examples of the wire 4 attached to the wire attaching portion 22 may include a single wire or a twisted wire formed by twisting a plurality of fine wires made of a metal material such as copper, aluminum, etc. In the present embodiment, the wire attaching portion 22 and the connecting piece attaching portion 21 are spatially divided by a partition wall 23. Accordingly, it is possible to inhibit water, etc. from entering the wire 4 from outside after mounting the terminal 1.

As illustrated in FIG. 3(A), the connecting member 3 is formed in a substantially cylindrical shape as a whole, and includes: a base portion 36, and a first connecting piece 32 and a second connecting piece 33 provided on the base portion 36. In the present embodiment, the base portion 36 includes a connection portion 31 through which connects the first and second connecting pieces 32 and 33 to each other, and a first insertion piece 34 and a second insertion piece 35 provided in the connection portion 31.

The first and second connecting pieces 32 and 33 are provided to extend to the counterpart terminal 5 side (a +Y direction side of FIG. 3(A)) from the base portion 36. Meanwhile, the first and second insertion pieces 34 and 35 are provided to extend to the wire 4 side (a +Y direction side of FIG. 3(A)) from the connection portion 31 of the base portion 36. In the present embodiment, the connection portion 31 extends along a circumferential direction D (see FIG. 4) with a substantially constant width. An insertion space 30 to which the counterpart terminal 5 is inserted is formed inside the connecting member 3.

A metal material having relatively higher Young's modulus than Young's modulus of the material contained in the main body member 2 is preferable as a material contained in the connecting member 3. Examples of such a material may include a copper alloy containing magnesium (preferably MSP-1), beryllium copper, phosphor bronze, etc. Accordingly, more excellent electrical property than that of the connecting member 3 may be assigned to the main body member 2 while allowing excellent connection between the connecting member 3 and the counterpart terminal 5. In the present embodiment, the base portion 36 and the first and second connecting pieces 32 and 33 are integrally formed.

Various plating processes may be performed on a surface of the connecting member 3 to form the plated layer 37 on the surface of the connecting member 3. The plated layer 37 is preferably harder than the plated layer 24 of the main body member 2 described above, and has hardness in a range of about 150 to 180 Hv. For example, a specific example of the plated layer 37 may include a hard silver (Ag) plated layer having a thickness in a range of about 5 to 10 μm. In this way, when the plated layer 37 of the connecting member 3 is harder than the plated layer 24 of the main body member 2, excellent wear resistance may be ensured in the connecting pieces 32 and 33 through which the counterpart terminal 5 is repeatedly inserted and removed. The plated layer 37 in the present embodiment corresponds to an example of a first plated layer in the invention. A metal layer made of the same material as that of the plated layer 37 may be further stacked on a surface of the plated layer 37 at distal ends of the first and second contact pieces 32 and 33. A specific example of such a metal layer may include a hard silver (Ag) layer having a thickness in a range of 40 to 50 μm.

In the connecting member 3 in the present embodiment, as illustrated in FIG. 4, first connecting pieces 32 and second connecting pieces 33 are disposed at substantially equal intervals along the circumferential direction D of the insertion space 30, and the first connecting pieces 32 and the second connecting pieces 33 are alternately disposed along the circumferential direction D. Accordingly, an operation of aligning the counterpart terminal 5 to a central axis of the insertion space 30 is facilitated when the counterpart terminal 5 is inserted into the insertion space 30. In the present embodiment, the first connecting piece 32 and the second connecting piece 33 have substantially the same width (width along the circumferential direction D). However, the invention is not particularly limited thereto. The first and second connecting pieces 32 and 33 may have different widths.

In the present embodiment, four first connecting pieces 32 in total and four second connecting pieces 33 in total are provided in the connection portion 31 of the base portion 36. However, the numbers of first connecting pieces 32 and second connecting pieces provided in the connection portion 31 are not particularly limited thereto. Disposition of the first and second connecting pieces 32 and 33 provided in the connection portion 31 is not particularly limited to the above-described disposition. It is preferable that the four first connecting pieces 32 and the four second connecting pieces 33 are provided in the connection portion 31 as in the present embodiment in terms of improvement in connection reliability and improvement in accuracy of positioning (aligning to the central axis) when the terminal 1 is connected to the counterpart terminal 5.

As illustrated in FIG. 3(B), a first contact portion 321 formed by bending the first connecting piece 32 in a protrusion shape is provided at the distal end of the first connecting piece 32. The first connecting piece 32 is closest to the central axis C of the connecting member 3 (see FIG. 4) at the first contact portion 321. At the time of connection with the counterpart terminal 5, the first contact portion 321 comes into contact with a side portion of the counterpart terminal 5 to electrically connect to each other.

Similarly, as illustrated in FIG. 3(B), a second contact portion 331 formed by bending the second connecting piece 33 in a protrusion shape is provided at the distal end of the second connecting piece 33. The second connecting piece 33 is closest to the central axis C of the connecting member 3 (see FIG. 4) at the second contact portion 331. At the time of connection with the counterpart terminal 5, the second contact portion 331 comes into contact with the side portion of the counterpart terminal 5 to electrically connect to each other.

Shapes of the first and second contact portions 321 and 331 are not particularly limited to the above-described shapes. For example, the distal ends of the first and second connecting pieces 32 and 33 may be bent inward in U-shapes to form the first and second contact portions 321 and 331. Alternatively, for example, the first and second contact portions 321 and 331 may be formed by providing protrusions or thick portions protruding inward at the distal ends of the first and second connecting pieces 32 and 33.

In the present embodiment, as illustrated in FIG. 3(B), the first contact portion 321 is relatively positioned on the distal end side of the connecting member 3 (a −Y direction side of FIG. 3(B)) with respect to the second contact portion 331. A length L1 of the first connecting piece 32 along a direction of the central axis C of the connecting member 3 is relatively longer than a length L2 of the connecting member 3 along the central axis C of the connecting member 3. In the present embodiment, since positions of base ends of the first and second connecting pieces 32 and 33 (positions along the direction of the central axis C) are substantially the same, and thus a distal end portion of the first connecting piece 32 is relatively positioned on the distal end side (the −Y direction side of FIG. 3(B)) with respect to a distal end portion of the second connecting piece 33. Accordingly, positioning (aligning to the central axis) is facilitated when the terminal 1 is connected to the counterpart terminal 5, and it is possible to reduce a necessary pressing force when the counterpart terminal 5 is inserted into the insertion space 30.

As illustrated in FIG. 4, the first contact portion 321 is relatively positioned on the central axis C side of the connecting member 3 with respect to the second contact portion 331. In other words, a diameter of a virtual circle W1 contacting with the first contact portion 321 is relatively smaller than a diameter of a virtual circle W2 contacting with the second contact portion 331. Both the diameters of the virtual circles W1 and W2 are smaller than a diameter R5 of the counterpart terminal 5 (see FIG. 1). For this reason, when the terminal 1 is connected to the counterpart terminal 5, the distal end portions of the first and second connecting pieces 32 and 33 are widened outward in a radial direction by the counterpart terminal 5. Accordingly, the counterpart terminal 5 is elastically pinched by the first and second connecting pieces 32 and 33.

As illustrated in FIG. 3(A) or 3(B), the first insertion piece 34 extends from the connection portion 31 in the +Y direction of the figure. In the present embodiment, two first insertion pieces 34 are provided in the connecting member 3. The two first insertion pieces 34 are disposed to face each other through the central axis C of the connecting member 3. The number of first insertion pieces 34 provided in the connecting member 3 is not particularly limited thereto. For example, it is possible to provide three or four first insertion pieces 34 disposed at substantially equal intervals along a circumferential direction of the connecting member 3.

A locking protrusion 341 is provided on an outer surface of a distal end portion of the first insertion piece 34. When the connecting member 3 is attached to the main body member 2, the locking protrusion 341 is locked to the step 215 (see FIG. 2) between the small diameter portion 211 and the large diameter portion 212 in the main body member 2. Therefore, a diameter R3 of the connecting member 3 excluding the locking protrusion 341 is less than or equal to the diameter R1 of the small diameter portion 211 of the main body member 2 (R3≤R1), and a diameter R4 of the connecting member 3 at the locking protrusion 341 is greater than the diameter R1 of the small diameter portion 211 of the main body member and less than or equal to the diameter R2 of the large diameter portion 212 (R1<R4≤R2). A width of the locking protrusion 341 along the central axis C of the connecting member 3 is less than or equal to a width of the large diameter portion 212 of the main body member 2. The diameter R3 of the connecting member 3 excluding the locking protrusion 341 is preferably close to a size of the diameter R1 to such an extent as to allow the connecting member 3 to be inserted into the small diameter portion 211 of the main body member 2 in terms of improvement in stability when the connecting member 3 is attached to the main body member 2.

Three second insertion pieces 35 are disposed at substantially equal intervals along the circumferential direction D between the first insertion pieces 34. A width of the second insertion piece 35 is relatively smaller than a width of the first insertion piece 34, and a length of the second insertion piece 35 along the central axis C of the connecting member 3 is relatively smaller than a length of the first insertion piece 34. The number of second insertion pieces 35 provided between the first insertion pieces 34 is not limited to the above-described number.

As illustrated in FIG. 3(A), a protrusion 351 protruding outward in a radial direction of the connecting member 3 is provided at a distal end portion of the second insertion piece 35. The protrusion 351 is disposed to come into contact with an inner wall of the small diameter portion 211 of the main body member 2 when the connecting member 3 is attached to the main body member 2. When the protrusion 351 comes into contact with the inner wall of the small diameter portion 211 of the main body member 2, it is possible to ensure an electrical connection between the connecting member 3 and the main body member 2 and to suppress an increase in electrical resistance value between the connecting member 3 and the main body member 2. In the present embodiment, one protrusion 351 is provided for one second insertion piece 35. However, the number of protrusions 351 provided on the second insertion piece 35 is not particularly limited.

In the present embodiment, the first and second insertion pieces 34 and 35 and the first and second connecting pieces 32 and 33 have substantially constant widths along the central axis C of the connecting member 3. However, the invention is not particularly limited thereto. For example, the first and second insertion pieces 34 and 35 or the first and second connecting pieces 32 and 33 may have non-uniform widths along the central axis C.

Figure 5:
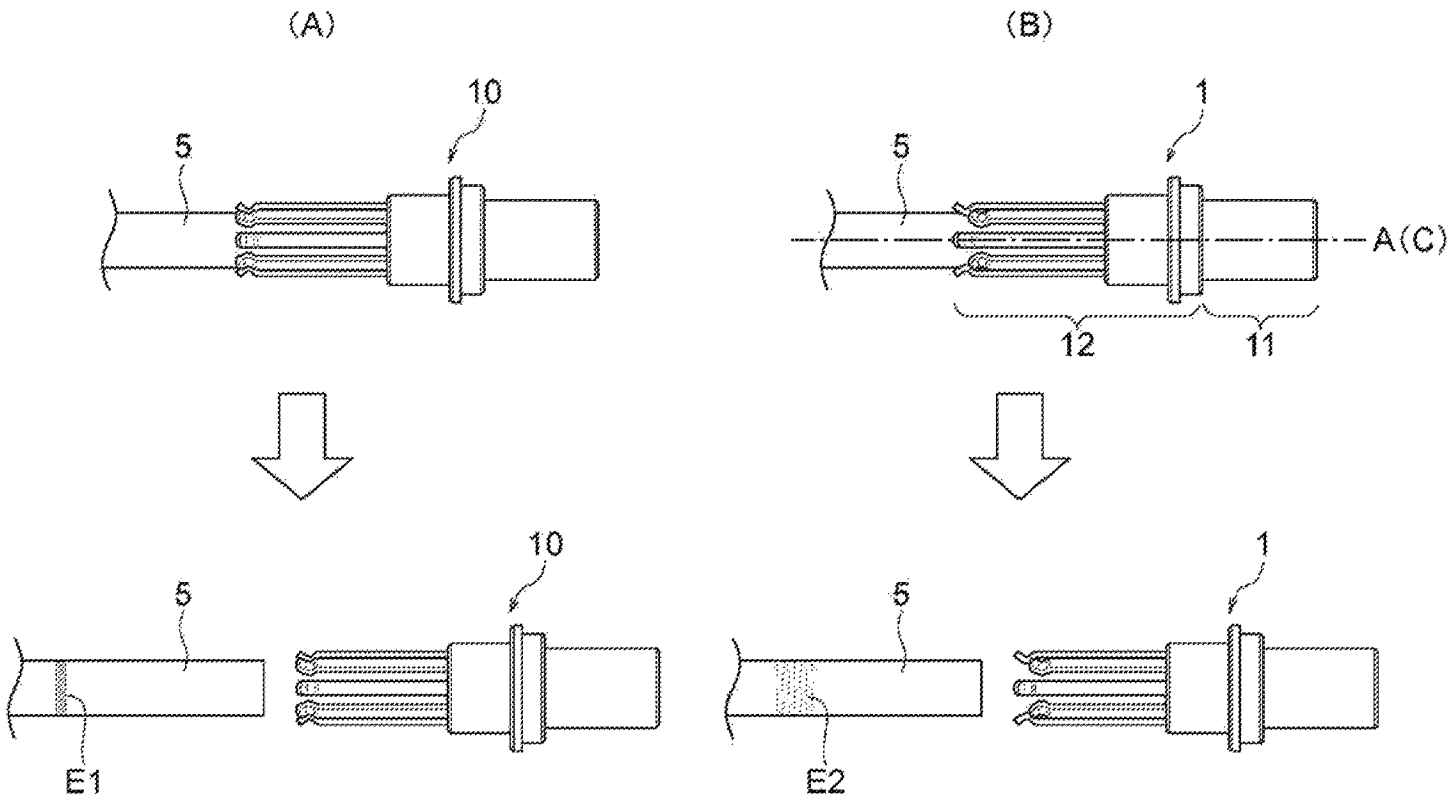
FIGS. 5(A) and 5(B) are side views for description of an action of the terminal in the embodiment of the invention, wherein FIG. 5(A) corresponds to a comparative example, and FIG. 5(B) corresponds to an example.

Hereinafter, an operation of the terminal 1 in the present embodiment will be described with reference to FIGS. 5(A) and 5(B). FIGS. 5(A) and 5(B) are diagrams for description of the operation of the terminal 1 in the present embodiment. FIG. 5(A) corresponds to a comparative example, and FIG. 5(B) corresponds to an example.

In the terminal 1 to be connected to the counterpart terminal 5 by a plurality of connecting pieces coming into contact with the counterpart terminal 5 around the counterpart terminal 5, if all lengths of the connecting pieces are substantially the same, dirt, dust, etc. attached to a surface of the counterpart terminal 5 is collected in a certain place E1 as attachment and detachment (insertion and removal) of the counterpart terminal 5 and the terminal 1 are repeated as illustrated in FIG. 5(A). This phenomenon particularly easily occurs when the terminal is used for a connector, etc. which is used for an electric vehicle charger installed outdoors. Dirt, dust, etc. accumulated on the surface of the counterpart terminal 5 in this way hinders contact between the counterpart terminal 5 and the terminal 1, and a poor connection may be generated between the terminal 1 and the counterpart terminal 5.

On the other hand, in the terminal 1 in the present embodiment, the first contact portion 321 and the second contact portion 331 coming into contact with the counterpart terminal 5 are disposed to be shifted from each other along the directions of the central axes A and C. Accordingly, even when attachment and detachment of the terminal 1 and the counterpart terminal 5 are repeated, dirt, dust, etc. attached to the surface of the counterpart terminal 5 is dispersed in a wider place E2 than the certain place E1 of FIG. 5(A) (see FIG. 5(B)). For this reason, it is possible to suppress accumulation of dirt, dust, etc. on the counterpart terminal 5, and to ensure an excellent connection between the terminal 1 and the counterpart terminal 5.

The first and second contact portions 321 and 331 are shifted from each other along the directions of the central axes A and C, thereby timing at which a distal end of the counterpart terminal 5 comes into contact with the first contact portion 321 and timing at which the distal end of the counterpart terminal 5 comes into contact with the second contact portion 331 may be shifted from each other when the counterpart terminal 5 is inserted into the insertion space 30 of the terminal 1 (see FIG. 1). In other words, it is possible to shift timing at which the distal end portion of the first connecting piece 32 is widened outward in the radial direction by insertion of the counterpart terminal 5 and timing at which the distal end portion of the second connecting piece 33 is widened outward in the radial direction by insertion of the counterpart terminal 5 from each other. Accordingly, a required pressing force for inserting the counterpart terminal 5 can be made relatively small in comparison with the case of FIG. 5(A), and an operation for a connection with the counterpart terminal 5 can be facilitated.

In the present embodiment, the first contact portion 321 is relatively positioned on a distal end side of the terminal connecting portion 12 (in the −Y direction of FIG. 1) with respect to the second contact portion 331 in the axial direction of the terminal connecting portion 12. Accordingly, when the counterpart terminal 5 is inserted into the insertion space 30, first, the distal end of the counterpart terminal 5 comes into contact with the first contact portion 321.

At this time, the first contact portion 321 is relatively positioned on a side of the central axes A and C of the terminal connecting portion 12 with respect to the second contact portion 331 (see FIG. 4) in the radial direction of the terminal connecting portion 12 (see FIG. 1). Accordingly, when the counterpart terminal 5 is inserted into the insertion space 30 of the terminal 1 (see FIG. 1), a distal end portion of the counterpart terminal 5 is aligned by relatively large contacting pressure by the first contact portion 321 at an initial insertion and positioned on the central axes A and C of the terminal 1, and then the distal end portion of the counterpart terminal 5 comes into contact with the second contact portion 331 by relatively small contacting pressure. For this reason, wear of the surface of the counterpart terminal 5 along with repeated attachment and detachment (insertion and removal) between the counterpart terminal 5 and the terminal 10 is reduced in an area contacting with the second contact portion 331, and connection reliability may be improved. The counterpart terminal 5 is aligned at two points (the first and second contact portions 321 and 331) along the axial direction. For this reason, it is possible to improve accuracy of positioning between terminals at the time of connection with the counterpart terminal 5. In the present embodiment, a length of the first connecting piece 32 along the axial direction in the terminal connecting portion 12 is relatively longer than a length of the second connecting piece 33 along the axial direction in the terminal connecting portion 12, and thus the above-described effect may be further improved.

Further, in the present embodiment, the first connecting pieces 32 and the second connecting pieces 33 are alternately disposed at substantially equal intervals along the circumferential direction D of the insertion space 30 (see FIG. 4). For this reason, it is possible to improve accuracy of aligning the central axis of the counterpart terminal 5 to the central axes A and C of the terminal 1 at the time of connection with the counterpart terminal 5.

The first connecting piece 32 is disposed to face another first connecting piece 32 through the insertion space 30, and the second connecting piece 33 is disposed to face another second connecting piece 33 through the insertion space 30. For this reason, it is possible to further improve accuracy of aligning the central axis of the counterpart terminal 5 to the central axes A and C of the terminal 1 at the time of connection with the counterpart terminal 5.

Figure 6:
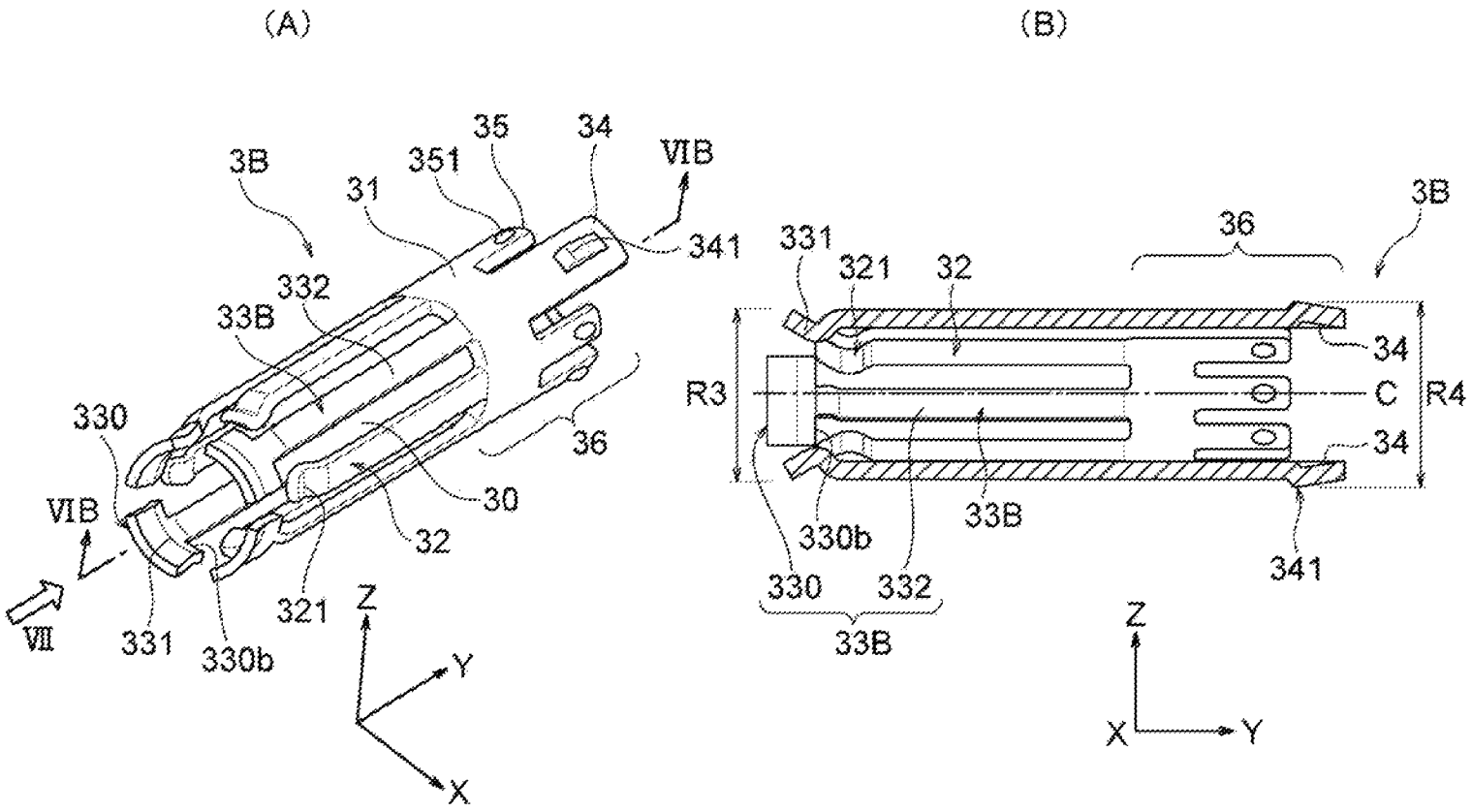
Figure 7:
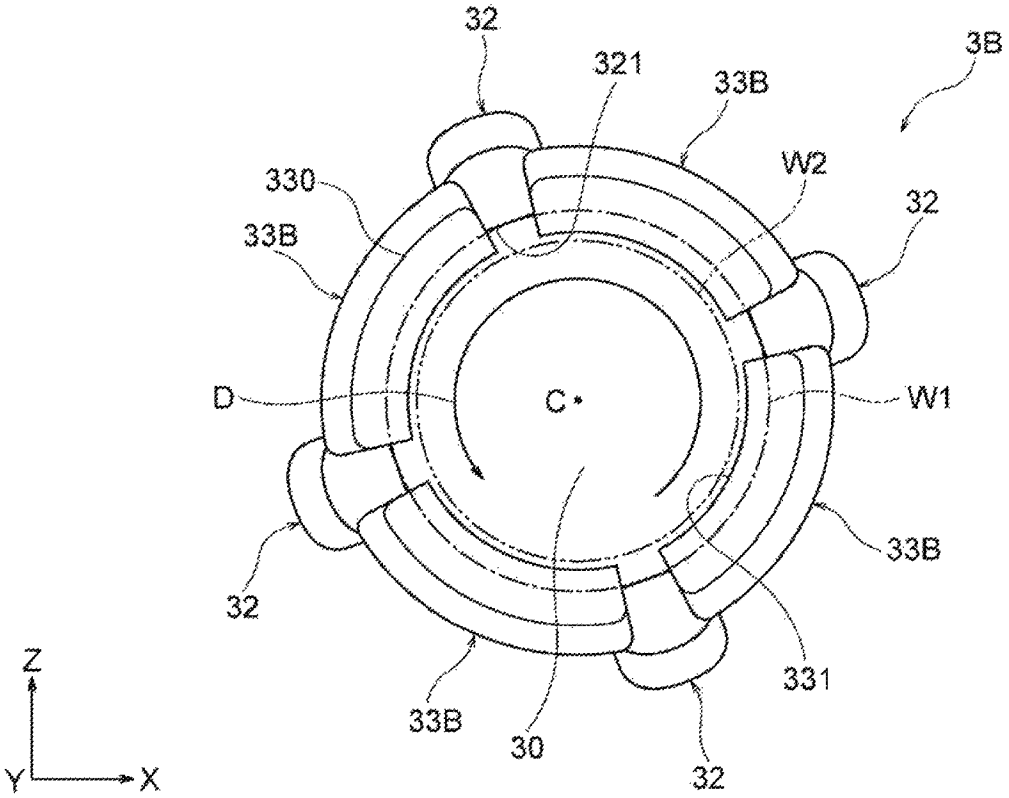
FIG. 7 is an arrow view in a direction VII of FIG. 6(A)

A shape of the second connecting piece of the connecting member is not particularly limited to the above-described shape. For example, the second connecting piece may be configured as illustrated in FIG. 6(A), FIG. 6(B), and FIG. 7. FIG. 6(A) and FIG. 6(B) are a perspective view and a cross-sectional view illustrating a modified example of the connecting member in the present embodiment, and FIG. 7 is an arrow view in a direction VII of FIG. 6(A). A configuration of a connecting member 3B is the same as the above-described configuration of the connecting member 3 except for a second connecting piece 33B, and thus the same reference symbol as that of the connecting member 3 will be assigned to the configuration, and a description thereof will be omitted.

As illustrated in FIG. 6(A) and FIG. 6(B), the second connecting piece 33B in the modified example includes a piece-shaped portion 332 which extends from a base portion 36 of the connecting member 3B to the counterpart terminal 5 side (a −Y direction side of FIG. 6(A)), and a wide-width portion 330 provided at a distal end of the piece-shaped portion 332. The piece-shaped portion 332 in the present embodiment has substantially the same width (width along the circumferential direction D (see FIG. 4)) as that of the first connecting piece 32, and has a relatively slightly larger length (length along a Y-axis direction of FIG. 6(B)) than that of the first connecting piece 32.

The wide-width portion 330 has a large width (width along the circumferential direction D) than that of the piece-shaped portion 332, and is formed to extend along the circumferential direction D. The wide-width portion 330 and the piece-shaped portion 332 are connected to each other at an approximately center of a width along the circumferential direction D. For this reason, a T-shape is formed by the wide-width portion 330 and the piece-shaped portion 332. Although not particularly illustrated, for example, the wide-width portion 330 and the piece-shaped portion 332 may form an L-shape by connecting the piece-shaped portion 332 to an end portion of the wide-width portion 330.

In the present embodiment, the wide-width portion 330 is formed to go around to the front side of a distal end of the first connecting piece 32. In other words, a portion of a rear end portion 330*b* of the wide-width portion 330 is formed so as to face the distal end of the first connecting piece 32.

A second contact portion 331 formed by bending the wide-width portion 330 in a protrusion shape is provided in the wide-width portion 330 in the present embodiment. The second connecting piece 33 is closest to the central axis C of the connecting member 3 (see FIG. 7) at the second contact portion 331, and the second contact portion 331 comes into contact with the side portion of the counterpart terminal 5 to ensure an electrical connection at the time of connection with the counterpart terminal 5. The second contact portion 331 in the present embodiment is formed across a whole width of the wide-width portion 330, and a total area of the second contact portion 331 provided in one second connecting piece 33 is relatively larger than a total area of the first contact portion 321 provided in one first connecting piece 32.

In the present embodiment, as illustrated in FIG. 6(B), the second contact portion 331 is relatively positioned on the distal end side of the connecting member 3 (a −Y direction side of FIG. 6(B)) with respect to the first contact portion 321. As illustrated in FIG. 7, the second contact portion 331 is relatively positioned on the central axis C side of the connecting member 3 with respect to the first contact portion 321. In other words, the diameter of the virtual circle W2 coming into contact with the second contact portion 331 is relatively smaller than the diameter of the virtual circle W1 coming into contact with the first contact portion 321. Both the diameters of the virtual circles W1 and W2 are smaller than the diameter R5 of the counterpart terminal 5 (see FIG. 1). For this reason, when the terminal 1 is connected to the counterpart terminal 5, the distal end portions of the first and second connecting pieces 32 and 33 are widened outward in the radial direction by the counterpart terminal 5. Accordingly, the counterpart terminal 5 is elastically pinched by the first and second connecting pieces 32 and 33.

Figure 8:
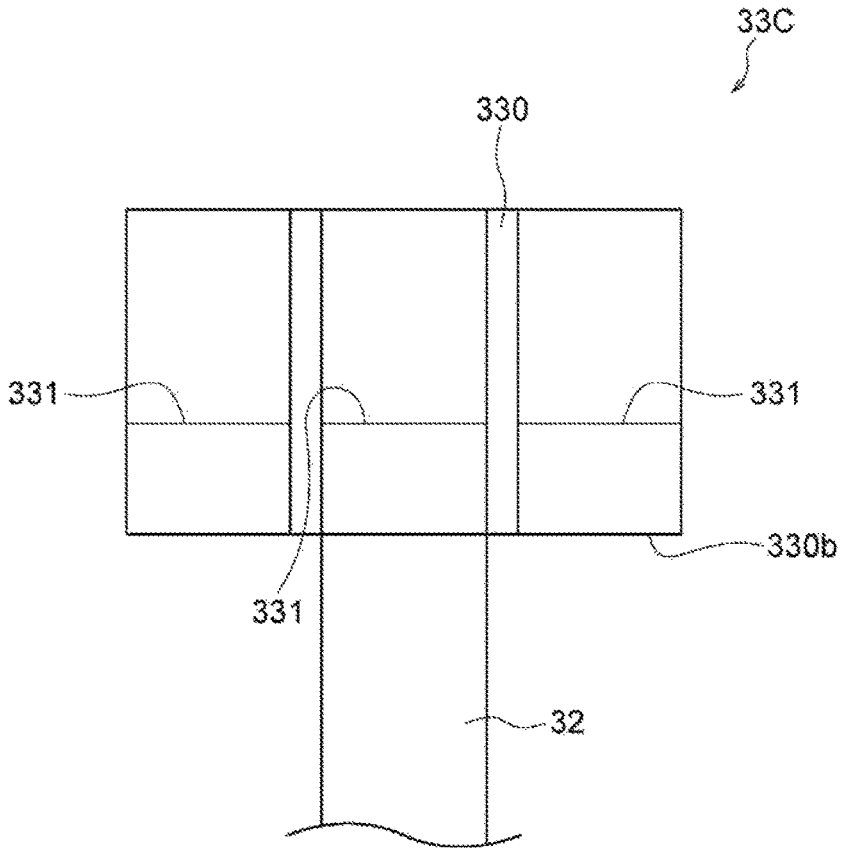
FIG. 8 is a diagram illustrating an additional modified example of a second connecting piece in the embodiment of the invention.

As illustrated in FIG. 8, a plurality of contact portions 331 may be provided with respect to one wide-width portion 330 by providing a plurality of protrusions or thick portions with respect to one wide-width portion 330. In this case, it is preferable that a total area of all the second contact portions 331 provided in one second connecting piece 33C is relatively larger than a total area of all first contact portions 321 provided in one first connecting piece 32. FIG. 8 is a diagram illustrating an additional modified example of the second connecting piece in the present embodiment, and is a front view obtained when the wide-width portion 330 is viewed from inside.

Hereinafter, a description will be given of an operation of the terminal 1 in the modified example.

It is required to ensure a wide contact area between the terminal and the counterpart terminal in order to improve connection reliability between the terminal and the counterpart terminal. In particular, when a large current flows in the terminal and contact between the terminal and the counterpart terminal is insufficient, the terminal may increase in temperature and an electrical resistance value between the terminals may increase. In this regard, concerning a terminal connected to the counterpart terminal by contacting a plurality of connecting pieces with the counterpart terminal around the counterpart terminal, if a plurality of contact pieces have the substantially same shape, an increase in contact area with the counterpart terminal is limited, and thus it is difficult to improve reliability of a connection between the terminal and the counterpart terminal.

On the other hand, in the present example, the second connecting piece 33B has the wide-width portion 330 formed to go around to the front side of the distal end of the first connecting piece 32. The second contact portion 331 provided in the wide-width portion 330 is contacted with the counterpart terminal 5. For this reason, a contact area (total area) between the terminal and the counterpart terminal 5 can be relatively increased in comparison with the terminal in which the plurality of contact pieces have the substantially same shape. Accordingly, it is possible to improve reliability of a connection between the terminal and the counterpart terminal 5. In addition, it is possible to suppress an increase in temperature of the terminal and an increase in electrical resistance value between the terminals when a large current flows in the terminal.

Next, a description will be given of a method for producing the terminal 1 in the present embodiment with reference to FIG. 9(A) to FIG. 9(D). FIG. 9(A) to FIG. 9(D) are perspective views illustrating respective producing processes of the terminal in the present embodiment.

Figure 9:
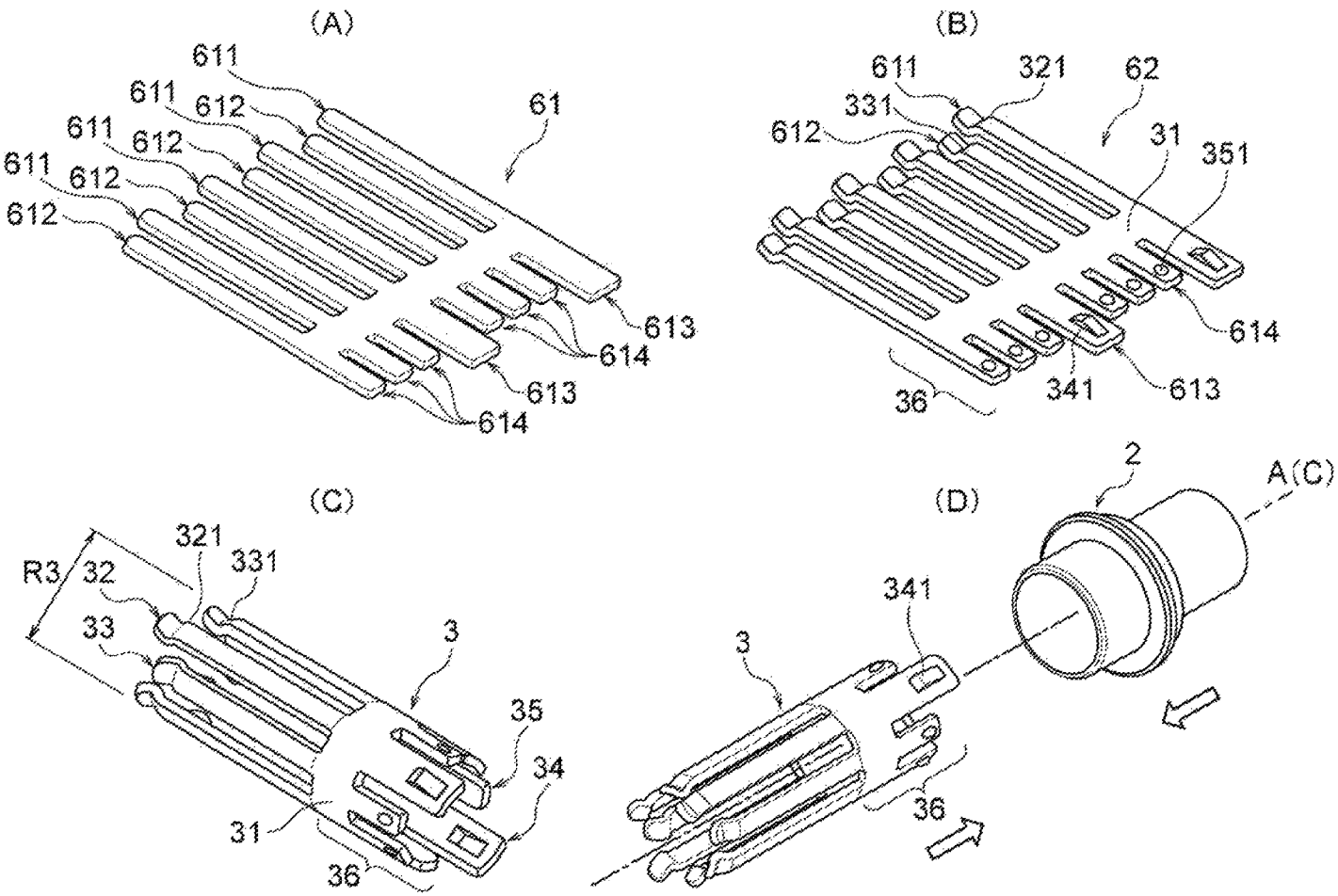
FIGS. 9(A) to 9(D) are perspective views illustrating respective producing processes of the terminal in the embodiment of the invention.

First, as illustrated in FIG. 9(A), a cutting process by punching is performed on a plate-shaped member made of a metal material for configuring the connecting member 3 so as to form a first processed body 61 provided with a first piece shape 611 corresponding to the first connecting piece 32, a second piece shape 612 corresponding to the second connecting piece 33, a third piece shape 613 corresponding to the first insertion piece 34, and a fourth piece shape 614 corresponding to the second insertion piece 35. The cutting process to the plate-shaped member is not particularly limited to punching. For example, clipping, etc. may be employed.

Subsequently, as illustrated in FIG. 9(B), a pressing process is performed on the first processed body 61 having a flat plate shape and a flat shape so as to form a second processed body 62. Specifically, a pressing process is performed on distal ends of the first piece shape 661 and the second piece shape 612 having flat shapes, thereby the first contact portion 321 bent in the protrusion shape is formed at the distal end of the first piece shape 611 and the second contact portion 331 bent in the protrusion shape is formed at the distal end of the second piece shape 612. A pressing process is performed on distal ends of the third transformed shape 663 and the fourth piece shape 664 having flat shapes, thereby the locking protrusion 341 is formed at the distal end of the third piece shape 613 and the protrusion 351 is formed at the distal end of the fourth piece shape 614.

The second processed body 62 in the present embodiment corresponds to an example of a processed body of the invention. The process of forming the first processed body 61 (process illustrated in FIG. 9(A)) and the process of forming the second processed body 62 (process illustrated in FIG. 9(B)) described above correspond to an example of a first process in the invention.

Subsequently, as illustrated in FIG. 9(C), the connecting member 3 is formed by performing a process of bending the second processed body 62 in a cylindrical shape such that a portion excluding the locking protrusion 341 has a predetermined diameter R3. The process of bending the second processed body 62 in the cylindrical shape (process illustrated in FIG. 9(C)) corresponds to an example of a second process in the invention. If the plated layer 37 is formed on the surface of the connecting member 3, a plating process is performed on the second processed body 62 bent in the cylindrical shape. If the metal layer is further stacked on the surface of the plated layer 37 of the contact portions 321 and 331, spray application, etc. is partially performed on the surface of the plated layer 37.

Although not particularly illustrated, the main body member 2 is formed in parallel with formation of the connecting member 3. Specifically, the main body member 2 including the contact piece attaching portion 21 having the hole portion 210 and the wire attaching portion 22 having the hole portion 220 is formed by performing a machining process on a rod-shaped member made of a metal material for configuring the main body member 2. This process of forming the main body member 2 corresponds to an example of a third process in the invention. If the plated layer 24 is formed on the surface of the main body member 2, a plating process is performed on the main body member 2 which is formed by performing the machining process on the rod-shaped member.

Timing at which the third process is performed is not particularly limited as long as the third process is performed prior to a fourth process described below. Specifically, the third process may be performed before the first process, between the first process and the second process, or after the second process.

Subsequently, as illustrated in FIG. 9(D), the main body member 2 and the connecting member 3 are attached to each other. Specifically, the main body member 2 and the connecting member 3 are disposed such that the central axis A of the main body member 2 is matched with the central axis C of the connecting member 3. Then, the base portion 36 of the connecting member 3 is inserted into the hole portion 210 of the connecting piece attaching portion 21 of the main body member 2 until the locking protrusion 341 of the first insertion piece 34 is locked to the step 215 of the main body member 2 (see FIG. 2). Therefore, the main body member 2 and the connecting member 3 are fixed to each other, and the terminal 1 in the present embodiment may be produced. This process of attaching the main body member 2 and the connecting member 3 to each other (process illustrating in FIG. 9(D)) corresponds to an example of the fourth process in the invention.

Hereinafter, a description will be given of an operation of the method for producing the terminal 1 in the present embodiment.

The second processed body 62 is formed by performing the cutting process (punching) and the pressing process on the plate-shape member, and the connecting member 3 is formed by performing the process of bending the second processed body 62 in the cylindrical shape. Then, the terminal 1 in the present embodiment is produced by inserting the connecting member 3 into the hole portion 210 of the main body member 2. Accordingly, it is possible to easily form the first and second connecting pieces 32 and 33, etc. for connection with the counterpart terminal 5. For this reason, a process of producing the terminal 1 may be facilitated, and producing cost may be reduced in comparison with a case in which the whole terminal is produced by a machining process, etc.

In the present embodiment, the width of the connection portion 31 in the connecting member 3 may be substantially constant along the circumferential direction D, and thus it is possible to improve processing accuracy at the time of performing the process of bending the second processed body 62 in the cylindrical shape.

In the present embodiment, Young's modulus of the material contained in the connecting member 3 of the terminal 1 is relatively larger than Young's modulus of the material contained in the main body member 2. For this reason, the main body member 2 can be made of a material having more excellent electrical property than that of the connecting member 3 while allowing excellent electric connection by excellent elastic contact between the terminal 1 and the counterpart terminal 5 by appropriate elasticity of the first and second connecting pieces 32 and 33.

In the present embodiment, the locking protrusion 341 formed in the first insertion piece 34 is locked to the step 215 of the main body member 2, and the protrusion 351 formed in the second insertion piece 35 comes into contact with the inner wall of the hole portion 210 of the main body member 2. For this reason, it is possible to strongly fix the connecting member 3 and the main body member 2 to each other, to ensure an electrical connection between the connecting member 3 and the main body member 2, and to suppress an increase in electrical resistance value between the connecting member 3 and the main body member 2.

Further, the plated layer 37 may be formed on the surface of the connecting member 3 by performing the plating process on the second processed body 62 bent in the cylindrical shape. The plated layer 24 may be formed on the surface of the main body member 2 by performing the plating process on the main body member 2 which is formed by performing the machining process on the rod-shaped member. In other words, in the present embodiment, the terminal 1 is formed by combining the main body member 2 and the connecting member 3, which are separately formed, together. Thus, two types of plated layers 24 and 37 may be easily formed without an additional process of attaching or peeling a masking member. In addition, it is possible to suppress damage to the plated layer associated with a masking operation.

The above-described embodiment is described to facilitate understanding of the invention, and is not described to restrict the invention. Therefore, respective components disclosed in the above-described embodiment are intended to include all changes of design or equivalents belonging to the technical scope of the invention.

For example, although not particularly illustrated, a third connecting piece may be provided in the connecting member 3 in addition to the above-described first and second connecting pieces 32 and 33, a third contact portion coming into contact with the counterpart terminal 5 at the time of connection may be provided in the third connecting piece, and the first to third contact portions may be shifted in three steps along the directions of the central axes A and C. In this case, the same effect as that of the above-described embodiment may be accomplished.

EXPLANATIONS OF LETTERS OR NUMERALS

1 . . . terminal
11 . . . wire connecting portion
12 . . . terminal connecting portion
2 . . . main body member
21 . . . connecting piece attaching portion
210 . . . hole portion
211 . . . small diameter portion
212 . . . large diameter portion
215 . . . step
22 . . . wire attaching portion
23 . . . partition wall
24 . . . plated layer
3, 3B . . . connecting member
30 . . . insertion space
32 . . . first connecting piece
321 . . . first contact portion
33, 33B, 33C . . . second connecting piece
330 . . . wide-width portion
331 . . . second contact portion
332 . . . piece-shaped portion
36 . . . base portion
31 . . . connection portion
34 . . . first insertion piece
341 . . . locking protrusion
35 . . . second insertion piece
351 . . . protrusion
37 . . . plated layer
4 . . . wire
5 . . . counterpart terminal
61 . . . first processed body
611 to 614 . . . first to fourth piece shapes
62 . . . second processed body

The invention claimed is:

1. A terminal comprising:

a wire connecting portion to be connected to a wire; and a terminal connecting portion to be connected to a counterpart terminal, wherein the terminal connecting portion includes:

first contact portions to be connected to the counterpart terminal; and second contact portions to be connected to the counterpart terminal, the first contact portions and the second contact portions are disposed to be shifted from each other along an axial direction of the terminal connecting portion, the first contact portions are relatively positioned on a side of a distal end of the terminal connecting portion with respect to the second contact portions in the axial direction of the terminal connecting portion, the first contact portions are relatively positioned on a side of a central axis of the terminal connecting portion with respect to the second contact portions in a radial direction of the terminal connecting portion such that inner circumferential surfaces of the first contact portions are relatively positioned on the side of the central axis of the terminal connecting portion with respect to inner circumferential surfaces of the second contact portions in the radial direction, the first contact portions are disposed such that the respective first contact portions faces another of the first contact portions through a central axis of the terminal connecting portion, and the terminal connecting portion includes:

a main body member having a hole portion in which a step is formed, a connecting member including a base portion inserted into the hole portion and the connecting piece extending from one end of the base portion, the base portion includes:

a connection portion through which the connecting pieces connect to each other;

a first insertion piece which has an outwardly protruded protrusion and extends from an opposite end of the base portion located opposite to the one end of the base portion, the protrusion being contacted with an inner wall of the hole portion; and a second insertion piece which has an outwardly protruded locking protrusion and extends from the opposite end, the locking protrusion being locked to the step.

2. The terminal according to claim 1, wherein the terminal connecting portion includes a connecting piece forming an insertion space for inserting the counterpart terminal, the connecting piece includes:

first connecting pieces which have the first contact portions at distal ends of the first connecting pieces for elastically pinching the counterpart terminal, and second connecting pieces which have the second contact portions at distal ends of the second connecting pieces for elastically pinching the counterpart terminal, and a length of the first connecting piece along the axial direction in the terminal connecting portion is relatively longer than a length of the second connecting piece along the axial direction in the terminal connecting portion.

3. The terminal according to claim 2, wherein the second connecting pieces have wide-width portions in which the second contact portions are provided, and the respective second contact portions have area larger than that of the respective first contact portions.

4. The terminal according to claim 3, wherein each of the wide-width portions has the second contact portions.

5. The terminal according to claim 2, wherein the first connecting pieces and the second connecting pieces are alternately disposed at substantially equal intervals along a circumferential direction of the insertion space.

6. The terminal according to claim 1, wherein the second contact portions are disposed such that the respective second contact portions faces another of the second contact portions through a central axis of the terminal connecting portion.

7. The terminal according to claim 1, wherein the terminal connecting portion has a first plated layer which covers a surface of the connecting piece, and the wire connecting portion has a second plated layer relatively softer than the first plated layer.

8. A method for producing a terminal including connecting pieces arranged along a circumferential direction with intervals, the connecting pieces having contact portions to contact with a counterpart terminal, the method comprising:

a first process of forming a processed body by performing a cutting process on a plate-shaped member, the processed body including a base portion and the connecting pieces extending from one end of the base portion;

a second process of processing the processed body in a cylindrical shape;

a third process of forming a main body member having a hole portion; and a fourth process of inserting the base portion into the hole portion, wherein the contact portions include:

first contact portions to be connected to the counterpart terminal, and second contact portions to be connected to the counterpart terminal, the first contact portions and the second contact portions are disposed to be shifted from each other along an axial direction of the terminal connecting portion, the base portion includes:

a connection portion through which the connecting pieces connect to each other;

a first insertion piece which has an outwardly protruded protrusion and extends from an opposite of the base portion located opposite to the one end of the base portion; and a second insertion piece which has an outwardly protruded locking protrusion and extends from the opposite end, the first process includes forming the protrusion in the first insertion piece and forming the locking protrusion in the second insertion piece, the third process includes forming a step in an inner wall of the hole portion, and the fourth process includes locking the locking protrusion to the step and contacting the protrusion with the inner wall.

* * * * *